US008393027B2

(12) United States Patent
Weisberg

(10) Patent No.: US 8,393,027 B2
(45) Date of Patent: Mar. 12, 2013

(54) SPINAL SUPPORT PIVOT PILLOW

(76) Inventor: Allan Weisberg, Ardsley, NY (US)

( * ) Notice: Subject to any disclaimer, the term of this patent is extended or adjusted under 35 U.S.C. 154(b) by 114 days.

(21) Appl. No.: 12/606,817

(22) Filed: Oct. 27, 2009

(65) Prior Publication Data

US 2010/0101024 A1 Apr. 29, 2010

Related U.S. Application Data

(60) Provisional application No. 61/109,289, filed on Oct. 29, 2008.

(51) Int. Cl.
*A47C 20/00* (2006.01)

(52) U.S. Cl. ..... 5/636; 5/655.9; 5/657; 5/640

(58) Field of Classification Search ..... 5/630, 636, 5/640, 652, 655.9, 657
See application file for complete search history.

(56) References Cited

U.S. PATENT DOCUMENTS

| | | | | | |
|---|---|---|---|---|---|
| 2,522,120 | A * | 9/1950 | Kaskey et al. | 5/636 |
| 4,876,755 | A * | 10/1989 | Parrish | 297/284.3 |
| 5,123,132 | A * | 6/1992 | Dixon | 5/636 |
| 5,457,832 | A * | 10/1995 | Tatum | 5/636 |
| 5,974,607 | A * | 11/1999 | Smith | 5/636 |
| 6,073,288 | A * | 6/2000 | Berenstein | 5/636 |
| 6,123,389 | A * | 9/2000 | O'Connor et al. | 297/397 |
| 2002/0050007 | A1* | 5/2002 | Kim | 5/636 |
| 2003/0135927 | A1* | 7/2003 | Hsia | 5/640 |
| 2004/0006822 | A1* | 1/2004 | Milligan | 5/636 |
| 2008/0216244 | A1* | 9/2008 | Minton | 5/640 |
| 2008/0282474 | A1* | 11/2008 | Hsin | 5/640 |
| 2009/0133193 | A1* | 5/2009 | Weise | 5/640 |

* cited by examiner

*Primary Examiner* — William Kelleher
(74) *Attorney, Agent, or Firm* — Amster, Rothstein & Ebenstein LLP

(57) ABSTRACT

There is provided a spinal support pivot pillow including: (1) a central-cylindrical neck support roll having two ends; and (2) two generally circular head support cushions vertically connected at each of the two ends, the neck support contoured to support a head and a neck in a supine position, and the head support cushions contoured to support the head and the neck in a side posture position. The present invention may also be used with a corresponding pillow case which can be contoured to the pillow.

19 Claims, 2 Drawing Sheets

SPINAL SUPPORT PIVOT PILLOW

RELATED PATENT APPLICATIONS

This application claims priority to U.S. Provisional Patent Application No. 61/109,289, filed Oct. 29, 2008.

FIELD OF INVENTION

The present invention relates generally to a spinal support pivot pillow and case therefore.

SUMMARY OF THE INVENTION

It has now been found that the above and related objects of the present invention are obtained in the form of the spinal support pivot pillow of the present invention.

One embodiment of the present invention comprises a spinal support pivot pillow comprising a central-cylindrical neck support roll having two ends and two generally circular head support cushions connected substantially transverse to said neck support at the two ends, wherein said neck support is contoured to support a head and a neck in a supine position and the head support cushions are contoured to support the head and neck is a side posture position.

In at least one embodiment, the neck support roll and head support cushions are unitary.

In at least one embodiment, the neck support roll and head support cushions are separate parts that are removably connected.

In at least one embodiment, the two head support cushions are contoured on respective inner surfaces with an egg crate pattern.

In at least one embodiment, the two head support cushions are further contoured in the respective inner surfaces with a concave indent.

In at least one embodiment, the two head support cushions each have an outer surface which is smooth.

In at least one embodiment, the neck support roll is contoured on an outer surface to a generally curved surface to allow the pillow to pivot with a user when the user rotates between a supine position and a side posture position.

In at least one embodiment, the pillow further comprises an adjustable strap which connects to the two head support cushions and holds the pillow in place.

In at least one embodiment, the adjustable strap is a drawstring.

In at least one embodiment, the adjustable strap is a cord.

In at least one embodiment, the adjustable strap includes hook and loop fasterners.

In at least one embodiment, the adjustable strap includes a slide clasp.

In at least one embodiment, the neck support roll has a diameter in the range of approximately 3.25 inches to approximately 4.5 inches.

In at least one embodiment, the neck support roll has a diameter in the range of approximately 3.4 inches to approximately 3.75 inches.

In at least one embodiment, the neck support roll has a diameter of approximately 3.5 inches.

In at least one embodiment, the neck support roll has a length in the range of approximately 12 inches to approximately 22 inches.

In at least one embodiment, the neck support roll has a length in the range of approximately 15 inches to approximately 20 inches.

In at least one embodiment, the neck support roll has a length of approximately 17 inches.

In at least one embodiment, each of the two head support cushions have a thickness ranging from approximately 2.5 inches to approximately 5.5 inches.

In at least one embodiment, each of the two head support cushions have a diameter of the inner surface in the range of between approximately 4 inches to approximately 14 inches.

In at least one embodiment, the pillow further comprises a pillow case contoured to the pillow.

In at least one embodiment, the pillow case is a multi-segment pillow case comprising a first segment covering the neck support roll; and second and third segments covering the head support cushions.

In at least one embodiment, the neck roll support comprises traction vents sculpted in a lengthwise direction along an outer surface of the neck support roll.

Other features and advantages of the present invention will become readily apparent from the following detailed description, the accompanying drawings and the appended claims.

BRIEF DESCRIPTION OF THE DRAWINGS

The above and related objects, features and advantages of the present invention will be more fully understood by reference to the following, detailed description of the preferred, albeit illustrative, embodiments of the present invention when taken in conjunction with the accompanying figures, wherein.

DETAILED DESCRIPTION OF THE INVENTION

The present invention generally relates to a spinal support pivot pillow and case therefor.

Figure 1:
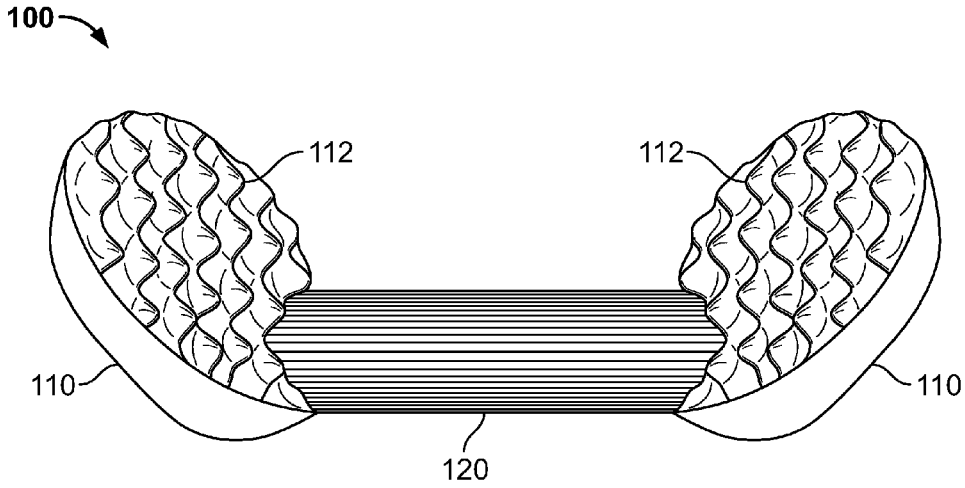
FIG. 1 shows a front isometric view of a pivot support pillow in accordance with an embodiment of the present invention as it would be used in a supine position.
Figure 2:
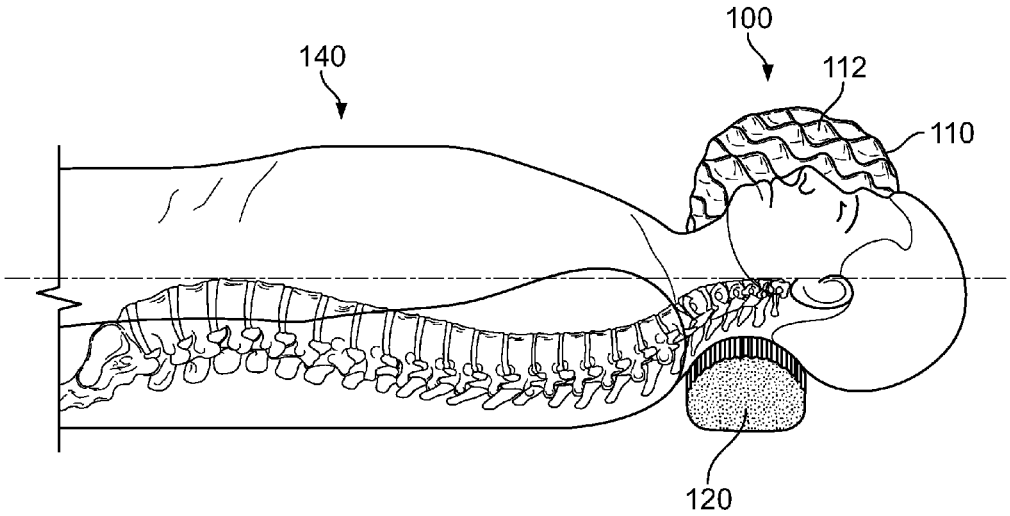
FIG. 2 shows a side view of the pivot support pillow of FIG. 1 being used in a supine position, with the left side cutaway.
Figure 3:
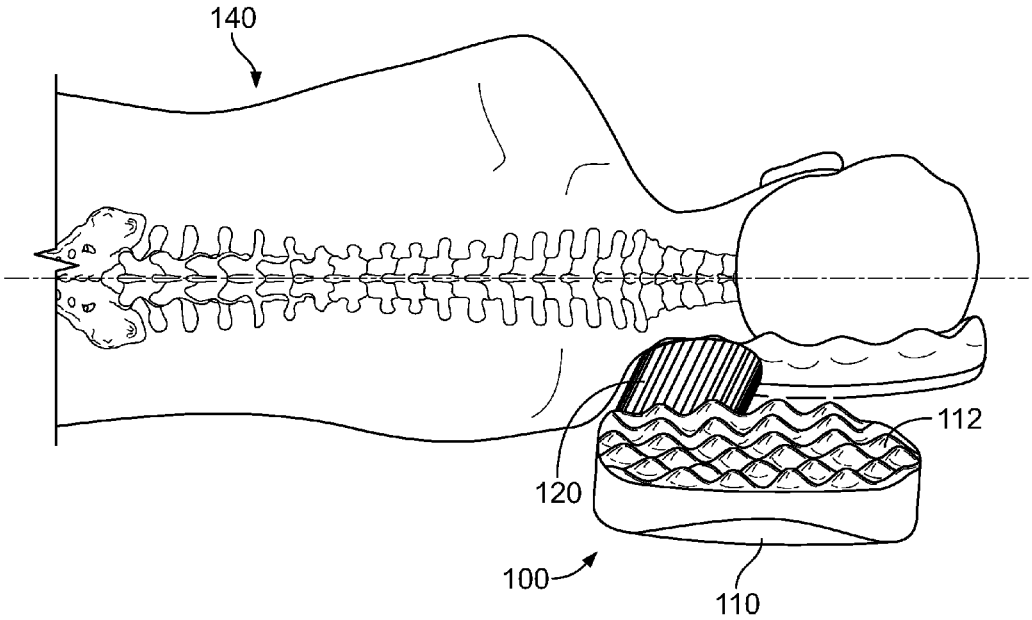
FIG. 3 show side view of the pivot support pillow of FIG. 1 being used in a side posture position.

FIG. 1 shows an embodiment of the spinal support pillow 100. FIG. 2 show an embodiment of the spinal support pivot pillow 100 of the present invention as it would be used in a supine position. FIG. 3 shows an embodiment of the spinal support pivot pillow 100 of the present invention as it would be used in a side posture position.

The spinal support pivot pillow 100 comprises a central-cylindrical neck support roll 120 having two ends; and two generally circular head support cushions 110 connected to the neck support roll 120 at the two ends. The head support cushions 110 are oriented substantially transverse to the neck support roll 120 so that the head support cushions 110 protrude obliquely outward when used in a supine position. In one embodiment not shown, the head support cushions 110 may protrude substantially vertically when used in a supine position. The head support cushions 110 and the neck support roll 120 may be unitary, however the head support cushions 10 may also be separate parts that are permanently or removably connected.

The neck support roll 120 and head support cushions 110 may be comprised of a variety of compressible and resilient materials. For example, the material may be one or more of the following or a composite of: a foamed plastic, foam rubber, polyurethane, or fiber material which provide softness in addition to firmness and resiliency. The material for the neck support roll 120 and head support cushions 110 can comprise numerous known densities and compressibilities.

In an embodiment of the present invention, the neck support roll 120 may be contoured to support a user's neck (e.g., lordotic spinal curve) and allow the user's head to rest in a substantially non-forward head posture position while the user 140 is in a supine position. Further, the head support cushions 110 may be contoured to support the head and the neck of the user 140 in a side posture position.

In an embodiment of the present invention, the neck support roll 120 may comprise traction vents which sculpted lines which run lengthwise along the surface of the neck support roll. These traction vents may reduce surface tension, contribute to the users comfort and/or provide a gentle spinal decompressive traction effect for the user.

In an embodiment of the present invention, the two head support cushions 110 may be further contoured on respective inner surfaces with an egg crate pattern 112. The two head support cushions 110 may also be further contoured in the respective inner surfaces with a concave indent. The concave indent is preferably shaped to comfortably fit the shape of the side of a head in a lateral or side posture position. The two head support cushions 110 may also each have an outer surface which is smooth and/or partially curved.

In an embodiment of the present invention, each of the two head support cushions 110 have a thickness ranging from approximately 2.5 inches to approximately 5.5 inches and a diameter of the inner surface in the range of between approximately 4 inches to approximately 14 inches. In another embodiment, the diameter of the inner surface may be in the range of between approximately 6 inches to approximately 12 inches. In a further embodiment the diameter of the inner surface may be in the range of between approximately 6 inches and 8 inches.

In an embodiment of the invention, the neck support roll 120 may be contoured on an outer surface to have a generally curved surface, which allows the pillow 100 to pivot or rotate with a user when the user turns or rotates between a supine position and a side posture position. In an alternative embodiment, the pillow provides the user support when the user turns or rotates between a supine position and a side posture position. The neck support roll 120 has a diameter in the range of approximately 3.25 inches to approximately 4.5 inches, and preferably in the range of approximately 3.4 inches to approximately 3.75 inches, and more preferably approximately 3.5 inches. The neck support roll 120 has a length in the range of approximately 12 inches to approximately 22 inches, and preferably in the range of approximately 15 inches to approximately 20 inches, and preferably approximately 17 or 18 inches.

In an embodiment, the head support cushions 110 may be attached to the neck support roll 120.

In an embodiment, the pillow 100 may also include an adjustable strap 130 (not shown) which connects to the two head support cushions 110 and holds the pillow 100 in place. For example, the strap 130 may be comprised of cord, lace, fabric, plastic, or the like. The strap 130 may be used as a drawstring. The strap 130 may include an adjustable fastening connector such as a buckle, slide clasp, hook and loop fasteners, or the like.

The pillow 100 may further include a corresponding pillow case (not shown). The pillow case can be contoured to the shape of the pillow 100. The pillow case may be permanent or removable. For example, the pillow case may be comprised of a textile material.

In an embodiment of the present invention, the pillow case may be a unitary pillow case covering the neck support roll 120 and the head support cushions 110. The pillow case may be secured in place over the pillow 100 with a fastening connector such as a zipper, snaps, buttons, hook and loop fasteners, or the like.

In an embodiment of the present invention, the pillow case may be a multi-segment pillow case covering the neck support roll 120 and the two head support cushions 110. A first segment of the pillow case may be a sheet of material wrapped around the neck support roll 120. The first segment may be secured in place over the neck support roll 120 by a fastening connector such as a zipper, snaps, buttons, hook and loop fasteners, or the like. Second and third segments of the pillow case may be sheets of material placed over the head support cushions 110. The second and third segments may include an elasticized edge that provides a tightened fit over the head support cushions 110 to hold the second and third segments in place. The second and third segments may also be secured in place by a fastening connector such as a zipper, snaps, buttons, hook and loop fasteners, or the like.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims and not by the foregoing specification.

What is claimed is:

1. A spinal support pivot pillow comprising:

a central-cylindrical neck support roll having two ends, wherein the neck support roll does not include a head back portion located between the two ends; and two generally circular head support cushions connected substantially transverse to said neck support at the two ends, wherein said neck support roll is contoured on an outer surface to a generally curved surface at each of the locations the neck support roll connects to the head support cushions, so as to allow the pillow to pivot with a user when the user rotates between a supine position and a side posture position, the neck support roll supporting a head and a neck in a supine position, and the head support cushions supporting the head and the neck in a side posture position.

2. The pillow of claim 1, wherein the neck support roll and head support cushions are unitary.

3. The pillow of claim 1, wherein the neck support roll and head support cushions are separate parts that are removably connected.

4. The pillow of claim 1, wherein the two head support cushions are contoured on respective inner surfaces with an egg crate pattern.

5. The pillow of claim 4 wherein the two head support cushions are further contoured in the respective inner surfaces with a concave indent.

6. The pillow of claim 4, wherein the 1, wherein the two head support cushions each have an outer surface which is smooth.

7. The pillow of claim 1, further comprising: an adjustable strap which connects to the two head support cushions and holds the pillow in place.

8. The pillow of claim 7, wherein the adjustable strap is a drawstring.

9. The pillow of claim 7, wherein the adjustable strap is a cord.

10. The pillow of claim 7, wherein the adjustable strap includes hook and loop fasteners.

11. The pillow of claim 7, wherein the adjustable strap includes a slide clasp.

12. The pillow of claim 1, wherein the neck support roll has a diameter in the range of approximately 3.25 inches to approximately 4.5 inches.

13. The pillow of claim 1, wherein the neck support roll has a diameter of approximately 3.5 inches.

14. The pillow of claim 1, wherein the neck support roll has a length in the range of approximately 12 inches to approximately 22 inches.

15. The pillow of claim 1, wherein the neck support roll has a length of approximately 17 inches.

16. The pillow of claim 1, wherein each of the two head support cushions have a thickness ranging from approximately 2.5 inches to approximately 5.5 inches.

17. The pillow of claim 1, wherein each of the two head support cushions have a diameter of the inner surface in the range of between approximately 4 inches to approximately 14 inches.

18. The pillow of claim 1, further comprising a pillow case contoured to the pillow.

19. The pillow of claim 1, wherein the neck roll support comprises traction vents sculpted in a lengthwise direction along an outer surface of the neck support roll.

* * * * *